US007331302B2

(12) United States Patent
Secretan et al.

(10) Patent No.: US 7,331,302 B2
(45) Date of Patent: Feb. 19, 2008

(54) QUICK CLOSE SECURITY DOOR SYSTEM

(76) Inventors: Stanley Secretan, 40014 95 St., West, Leona Valley, CA (US) 93551; Earl T. Bayless, 16600 Road Runner Rd., Canyon Country, CA (US) 91387

( * ) Notice: Subject to any disclaimer, the term of this patent is extended or adjusted under 35 U.S.C. 154(b) by 95 days.

(21) Appl. No.: 10/870,776

(22) Filed: Jun. 18, 2004

(65) Prior Publication Data

US 2005/0279266 A1 Dec. 22, 2005

(51) Int. Cl.
*B63B 19/00* (2006.01)
*B63B 19/08* (2006.01)

(52) U.S. Cl. ..... 114/117; 114/120

(58) Field of Classification Search ..... 114/116–120, 114/202, 362, 364, 78, 201 R, 203
See application file for complete search history.

(56) References Cited

U.S. PATENT DOCUMENTS

| | | | | |
|---|---|---|---|---|
| 1,337,060 | A * | 4/1920 | Foerster et al. | 114/118 |
| 1,594,513 | A | 8/1926 | Ainsworth | |
| 1,925,379 | A | 9/1933 | Gilbert | |
| 1,982,301 | A | 11/1934 | Harvey | |
| 2,217,852 | A | 10/1940 | Anderson | |
| 2,573,160 | A * | 10/1951 | Norman | 49/379 |
| 3,383,796 | A * | 5/1968 | Fredrick, Jr. et al. | 49/7 |
| 3,398,482 | A * | 8/1968 | Frederick, Jr. | 49/8 |
| 4,266,372 | A | 5/1981 | Taniwaki | |
| 5,195,448 | A | 3/1993 | Sims | |
| 6,484,650 | B1 | 11/2002 | Stomski | |
| 6,696,979 | B2 | 2/2004 | Manten | |
| 6,698,690 | B2 | 3/2004 | Novak | |
| 2003/0006342 | A1 | 1/2003 | Page | |

* cited by examiner

*Primary Examiner*—Ajay Vasudeva
(74) *Attorney, Agent, or Firm*—Law Office of David Hong

(57) ABSTRACT

A security door closure system for cruise ships and other similar public entrance points to prevent terrorist attack or ship take-over is needed. Cruise ship passenger and ship provisioning entrance gangplanks pass through large hydraulically operated shell doors. The gangplank must be removed to close the shell door. The quick close security door system (Door-Gate) is a portable bullet resistant rapid close door system that is placed in conjunction with the gangplank or other entry system, which when closed prevents forced entry. A single lever either remotely or manually operated immediately closes the doors, which then cannot be forced opened from the entrance side.

18 Claims, 9 Drawing Sheets

QUICK CLOSE SECURITY DOOR SYSTEM

BACKGROUND OF THE INVENTION

The present invention relates to preventing a sudden terrorist attack via a public entrance walkway in particular the entrance for passengers and provisioning access to a cruise ship. Passenger and provisioning access onto a cruise ship when dockside or when anchored is through what is referred to as a shell door located above the waterline of the ship. A gangplank or walkway is extended from the docking platform though the shell door into the ship lower deck vestibule or storage area. The shell door is hydraulically operated and cannot be closed when the gangplank is in place without moving the gangplank, a time consuming operation.

In the present order of things, security of a cruise ship and such other events as sports, air shows, music events rely heavily on the effectiveness of the pre-boarding or pre-entry screening of the individuals entering the activity to insure that weapons metallic or fabricated are not allowed to pass into the protected entry gang plank or access walkway.

The present invention provides an additional security system after pre-entry screening, an instantly closable, high-strength, ballistic resistant portable door system located at the ship gangplank or event entrance after the secured screening area. Closed remotely or locally upon sighting of an overt action, the door closure prevents an immediate presence or threat by forced entry onto a cruise ship gangplank or event entry gate.

The present invention provides a portable door closure system for instantly closing off an entry passage against unwanted or unauthorized intrusion from forced entry.

SUMMARY OF THE INVENTION

In accordance with the present invention, a portable quick close door system is placed immediately inside the shell door of a cruise ship after the ship is docked and the gangplank is put in place. The quick close door system is designed such as to allow the gangplank from the dock to the ship's shell door to be in place passing uninterrupted through the quick door system onto the ship's lower deck. The quick close door system has integral handrails continuing the gangplank handrails to the ships interior. The quick close doors, according to a preferred embodiment of the invention, are situated on opposite sides of the cruise ship at right angles to the gangplank. Kevlar filled doors are each hanging from overhead bars located within the left and right enclosures clamped to the shell door opening. The said door enclosures contain the doors allowing each to slide towards each other, meeting in the middle, closing off the gangplank walkway. The mating doors meet each other as tongue groove fittings providing a minimal grip area for forced opening form the ship's exterior gangplank. The said Kevlar lined enclosures block the shell door opening on each side of the gangplank floor to ceiling from terrorist entry or ballistic attack. The said doors are pulled closed by stretched strings via cable pulley arrangement. Said springs, a bungee type material, allow pre-stretch and door closed tension. Said doors are held open by keepers connected to a common release tube allowing manual door release from either side of the gangplank. Remote door release is possible with the addition of an electric latch solenoid and associated transmitter system.

Visual means such as a video camera placed outside the gangplank provides viewing of potential terrorists from any location on the ship allowing remote door closure. A peephole in the doors provides viewing of the gangplank after door closure.

The quick close door system is designed in separate left and right mating halves that bolt together with a keeper operation connecting rod. Each lightweight quick close door assembly has caster wheels and a handle installed for easy transport to a storage area within the ship.

Specific design configurations in the following descriptions are for purpose of clarity, but various details can be changed to fit applications other than cruise ship requirements within the scope of the present invention.

Modified embodiments of the present invention for other types of access passages, such as sports events, music concerts, and public events are also disclosed.

OBJECTS OF THE INVENTION

An object of the invention is to provide a cruise ship security system for the protection of a cruise ship from terrorists gaining entry on board the ship via storming the passenger gangplank or provisioning gangplank when the ship is docked at its homeport or other and Third World countries' docking locations.

Another object of the invention is to provide quick closure of bullet resistant doors immediately inside the ship's shell or entry doors where the passenger gangplank is installed preventing terrorist access to the ship's interior.

Another object of the invention is to provide a portable or fixed security door closure system for public events as sporting events, music events, indoors or outdoors. The quick close door system is placed after the entry screening process and before main access to the event. The quick close system will provide immediate closure of the event entrance via remote closure when a security guard is not present, and it is dangerous to be in the immediate vicinity or by manual door release keeper actuation by an attendant security guard.

Other and further objects of the invention will become apparent with an understanding of the following detailed description or upon employment of the invention in practice.

LIST OF REFERENCE NUMERALS IN FIGURES

1 Inside view of shell door with gangplanks in place.

2 Shell opening in cruise ship hull for loading and unloading.

3 Outside gangplank to dock.
4 Inside ramp to lower deck.
5 Outside hand rail to dock.
6 Ship's shell door latch.
7 Ship's shell door stop plate.
8 Quick close door system forward door assembly.
9 Quick close door system aft door assembly.
10 Quick close door system installation locking bar.
11 Quick close door system transport caster.
12 Quick close door system door assembly transport handle.
13 Quick close door system inside hand rail to lower deck.
14 Quick close door system retracted door, release handle.
15 Quick close door system door closure spring.
16 Quick close door system retracted forward door.
17 Quick close door system retracted aft door.
18 Quick close door system stand off to ship's hull inside.
19 Floating or at port ship's dock area.
20 Ship's hull inside.
21 Quick close door system extended (closed) forward door.
22 Quick close door system extended (closed) aft door.
23 Door assembly outer slide tube.
24 Door assembly inner slide tube.
25 Door closure cable pulley.
26 Door closure cable termination point.
27 Door keeper control tube.
28 Door keeper rotation arm cable termination.
29 Door keeper.
30 Aft/Forward rotation keying tube.
31 Keying tube insertion button.
32 Forward/Aft door system central mating plate.
33 Quick close door system outer casing.
34 Door closure cable.
35 Door keeper release cable.
36 Safety pin.
37 Security pre-screening area of a public event.
38 Quick close door system installation.
39 Public event area.

DETAILED DESCRIPTION OF THE PREFERRED EMBODIMENT

Figure 1:
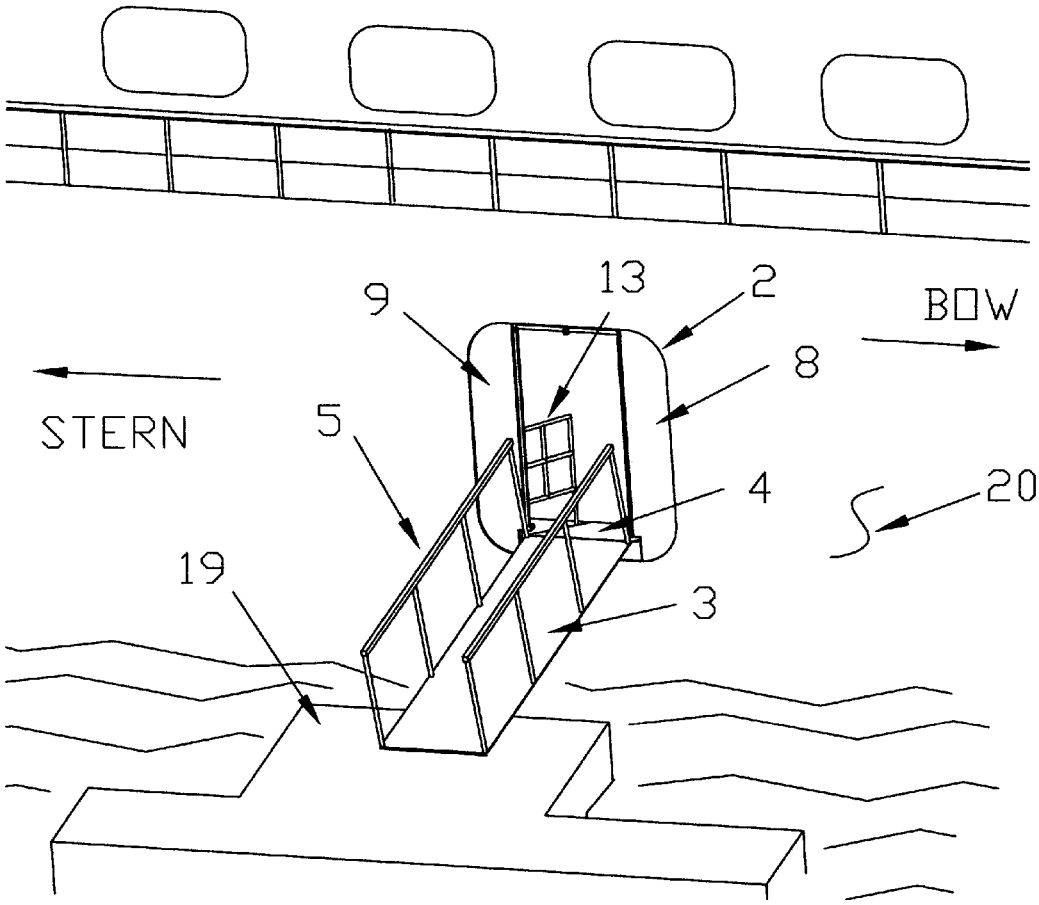
FIG. 1—Long view of an anchored cruise ship with gangplank to dock installed and quick close door system installed in shell door opening.

Referring to FIG. 1 of the figures, a cruise ship hull (20) has numerous entrance doors, called shell doors (2) located above the waterline shell doors are used to access the ship, via a gangplank (3) with handrails (5) leading to a inside ramp (4) and associated handrail (13) which terminates on the ship's lower deck inside the ship. These shell doors are used for passenger loading and embarkation from the ship when the ship is at port or anchored at a floating dock (19). Similar shell doors are also used for loading and unloading ships provisions.

Figure 2:
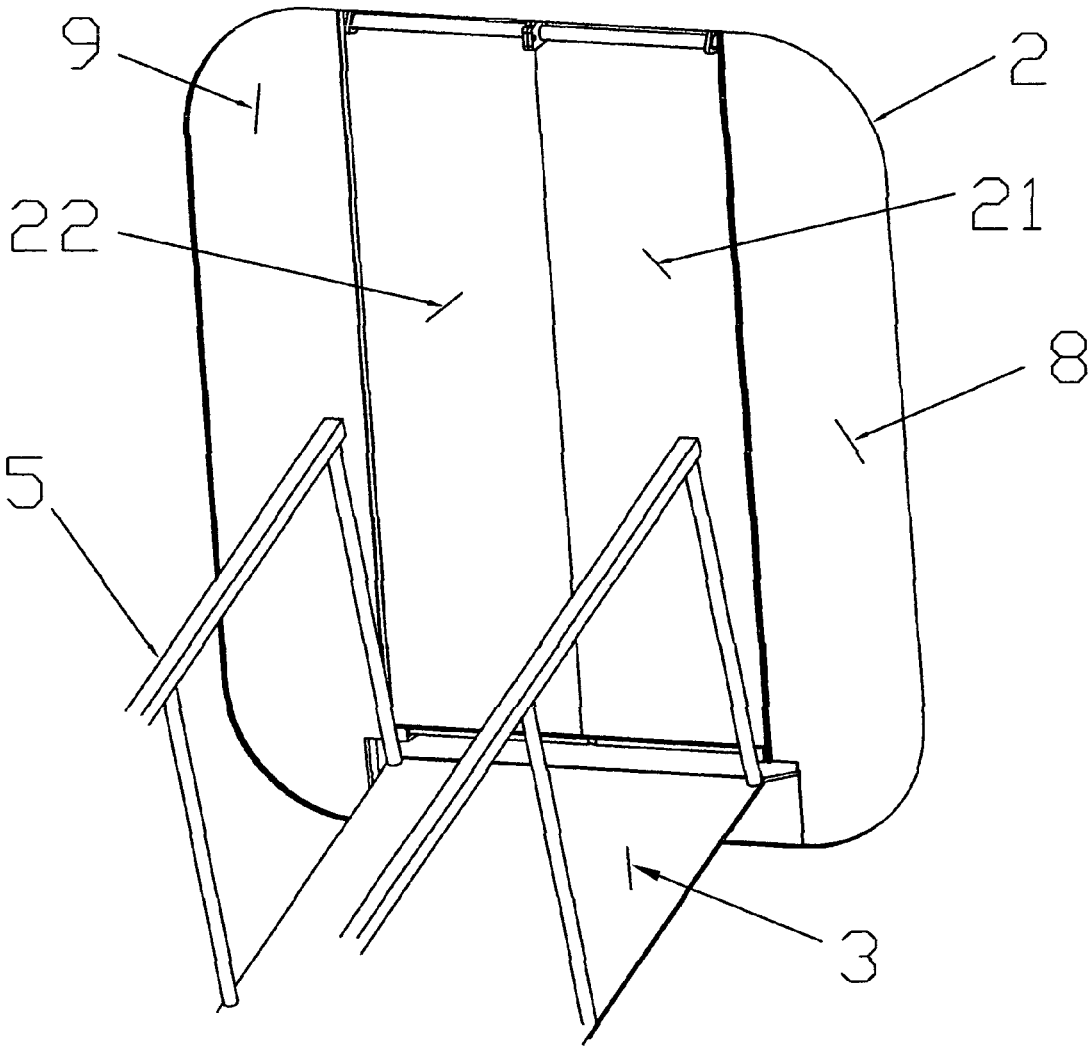
FIG. 2—Close up view of quick close door system installed in shell door opening showing quick close door system doors closed.

In accordance with the preferred embodiment of the invention, after docking and opening of the ship's shell door (2) a portable Quick Close Door System (8) and (9) herein referred to as "QCDS" is installed inside the ship whereby providing a means to quickly close off access to the ship's interior from a terrorist threat. FIG. 2 shows the shell door opening (2) with the QCDS doors (21) and (22) closed and installed inside the ship as seen from the outside of the ship. The ship's gangplank passes under the doors (21) and (22) of the QCDS. The QCDS (8) and (9) outer casings (33) block the shell door opening from access around the gangplank.

Figure 3:
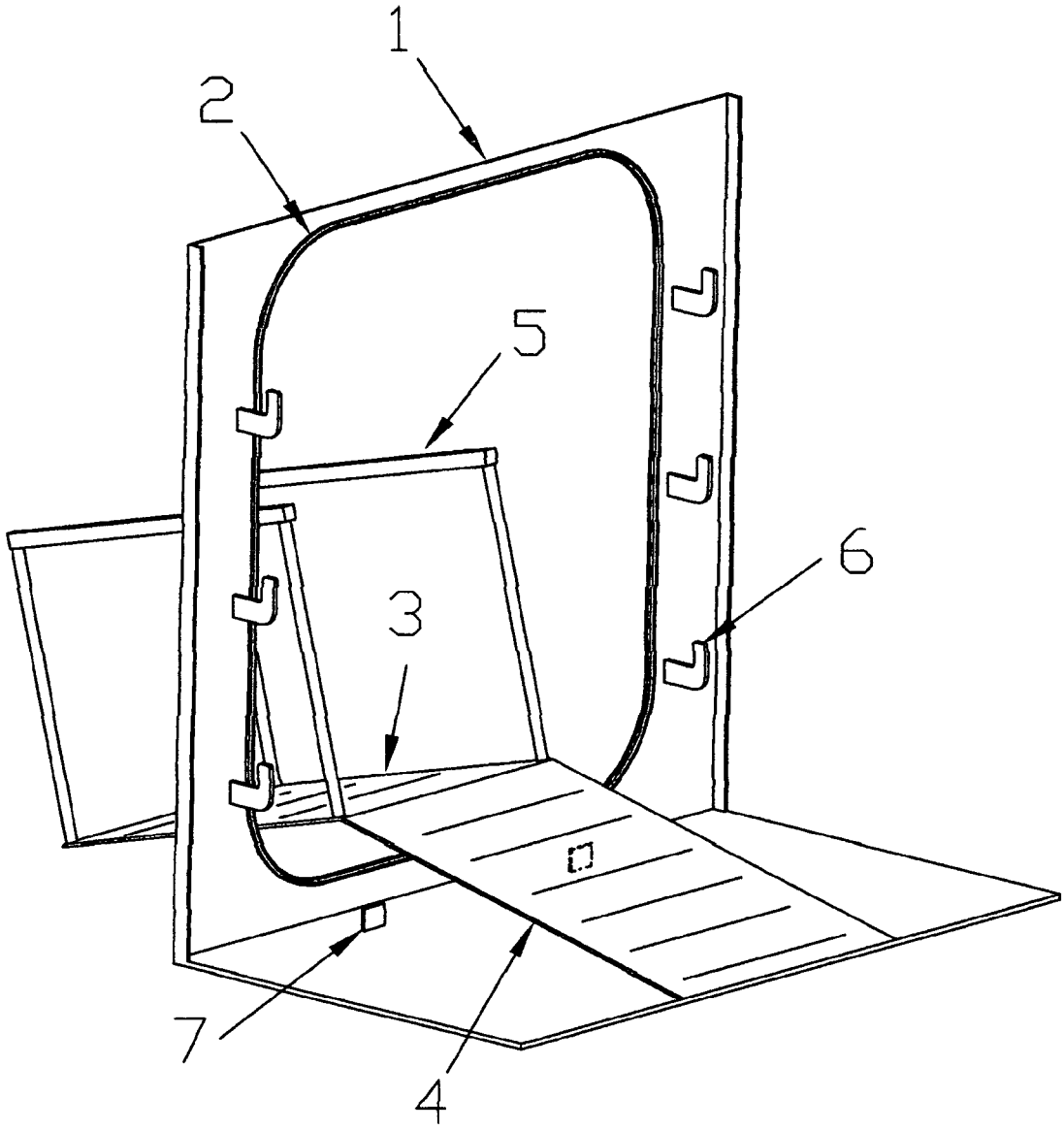
FIG. 3—Cruise ship entry gangplank passing through ships shell door opening.

Referring to FIG. 3, the inside hull of the ship (1) is shown with the shell door opened and the gangplank (3) installed; the inside ramp (4) is installed leading onto the lower deck entrance vestibule. The ship's shell door latches (6) are shown. The ship's shell door stop plates (7) are also shown.

Figure 4:
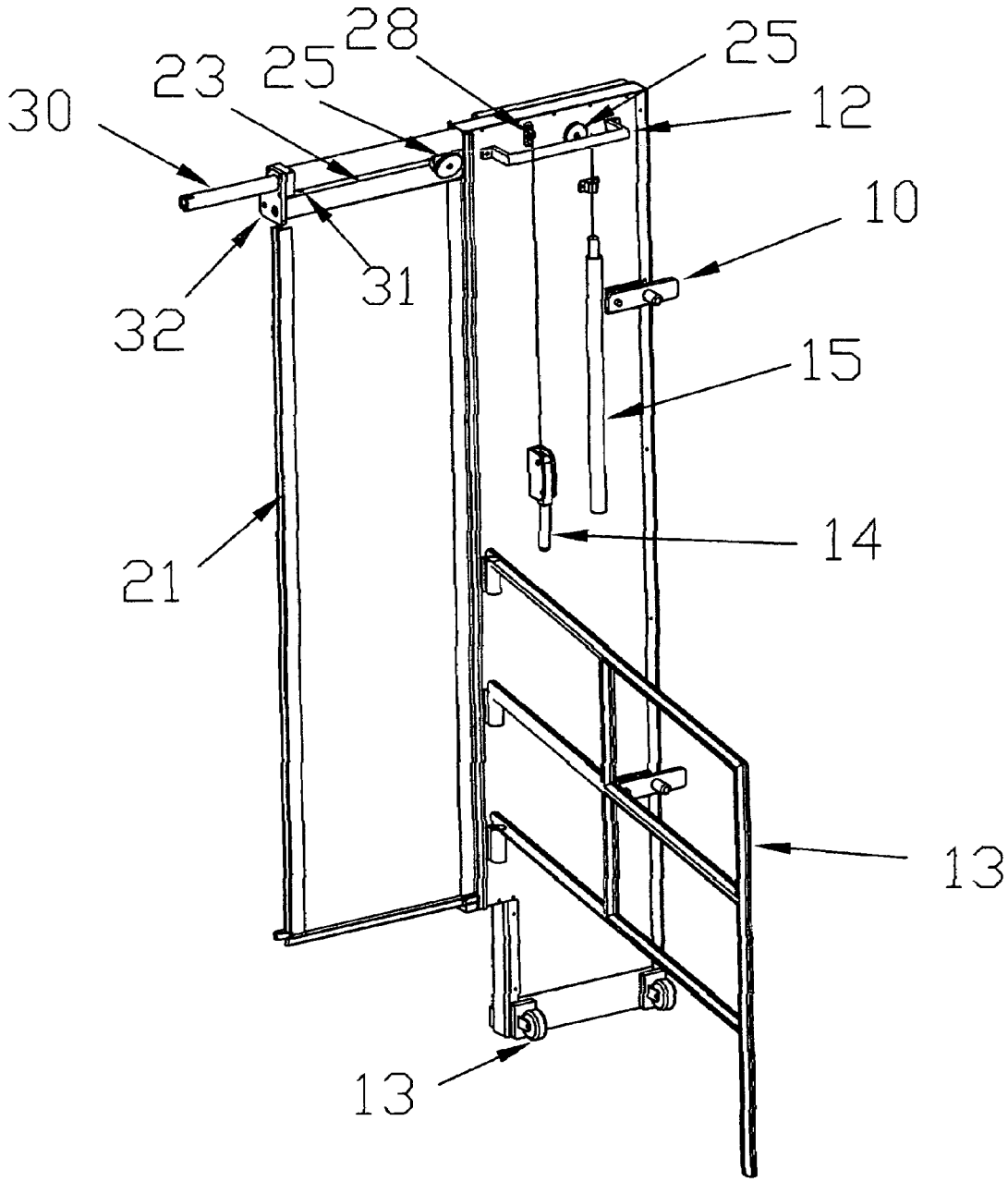
FIG. 4—View of quick close door system aft door assembly. Forward door assembly is the mirror image of this door assembly except the rotation key tube is only on the aft door.
Figure 5:
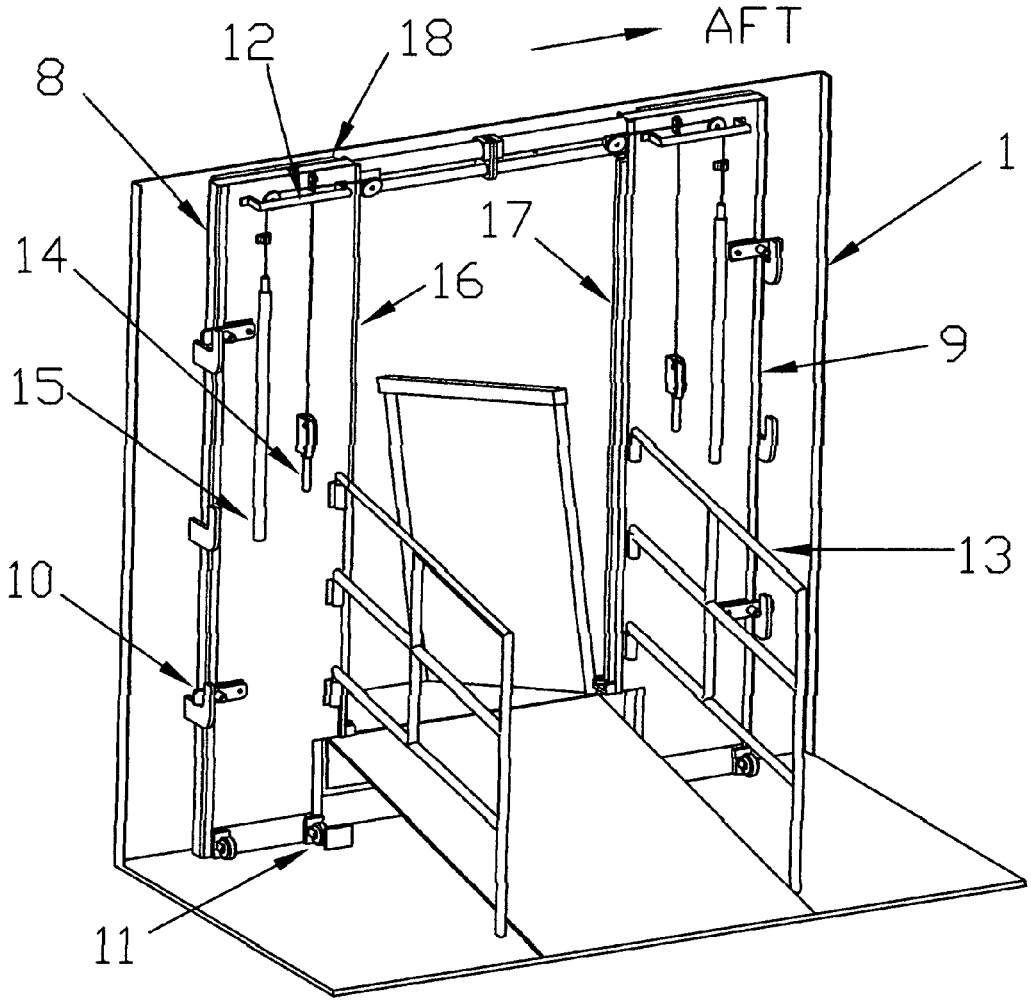
FIG. 5—Detailed view from inside of ship of quick close door system installed in ship's shell door opening with gangplank in place.

Referring to FIG. 5, the quick close door system (QCDS) is comprised of two portable mating sections (8) and (9), which using handle (12) are rolled on casters (11), up to the open shell door opening FIG. 3, bolted together at (32), forward/aft door system central mating plate, with locking bars (10) in place. FIG. 4 shows the aft QCDS (9) with door (21) in the extended or closed position. The fwd QCDS (8) is essentially the mirror image of the aft (9) QCDS, an exception being the aft/forward rotation keying tube (30) shown is replaced in the forward (8) QCDS with a mating key pin internal to the door keeper control tube (27). The aft QCDS (9) is detailed in FIG. 4. QCDS (9) is comprised of outer casing (33), and inner door (21). The inner door (21), slides out of the outer casing (33) closing off the shell door opening (2). The outer casing (33) is locked in place by rotating bars (10) onto latch's (6) locking the QCDS (9) to the shell door opening (2). The QCDS (8) and (9) retracted door release handle (14), releases the spring loaded doors (21) and (22) allowing them to extend closing the QCDS opening. Said release handle (14), releases aft and forward doors simultaneously though the rotation of keying tube (30) providing immediate closure of both aft (22) and forward door (21) of FIG. 2. Shown in FIG. 4, is the removable hand rail (13); the handrail is a continuation of the outside handrail (5) on the gangplank. Removal of the handrail makes each QCDS lighter weight for portability as well as being readily adapted to various gang plank heights and configurations. The forward (8) and aft (9) QCDS are installed with their respective doors in the retracted position with the release handle safety pin (36) in place. See detailed operation of the preferred embodiment FIG. 6.

Referring to FIG. 5, the inside hull is shown as in FIG. 3 with the assembled forward (8) and aft (9) FIG. 4 QCDS installed. When installing the QCDS, the QCDS casters (11) are lifted over the ship's door stop plates (7). The stop plates retain the said casters (11) in place preventing the QCDS from being pushed into the ship's vestibule area. Locking bar (10) is pivotably rotated onto the ship's shell door latches (6). Standoffs (18) of a compressible material, as low shore rubber, provides a cushion between the QCDS outer shell (33) and the ship's hull interior providing compressed rubber pressure on the locking bar (10) when rotated in position.

Figure 6:
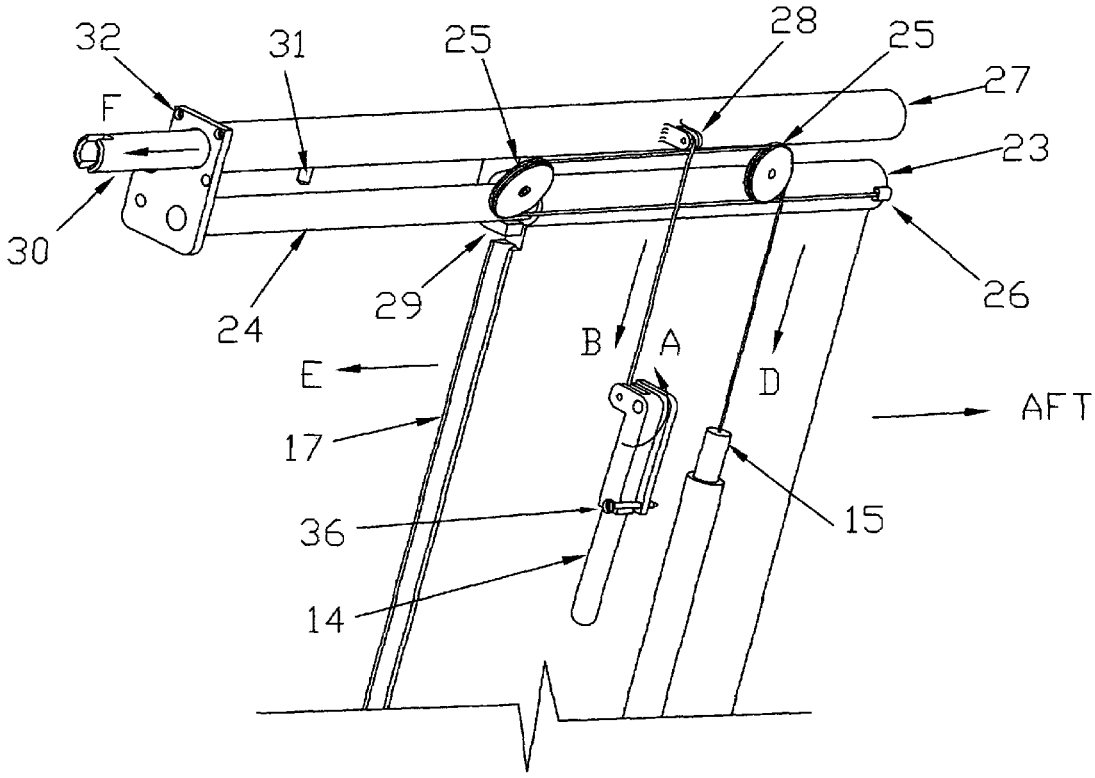
FIG. 6—Detailed inside view of quick close door system operational components.
Figure 7:
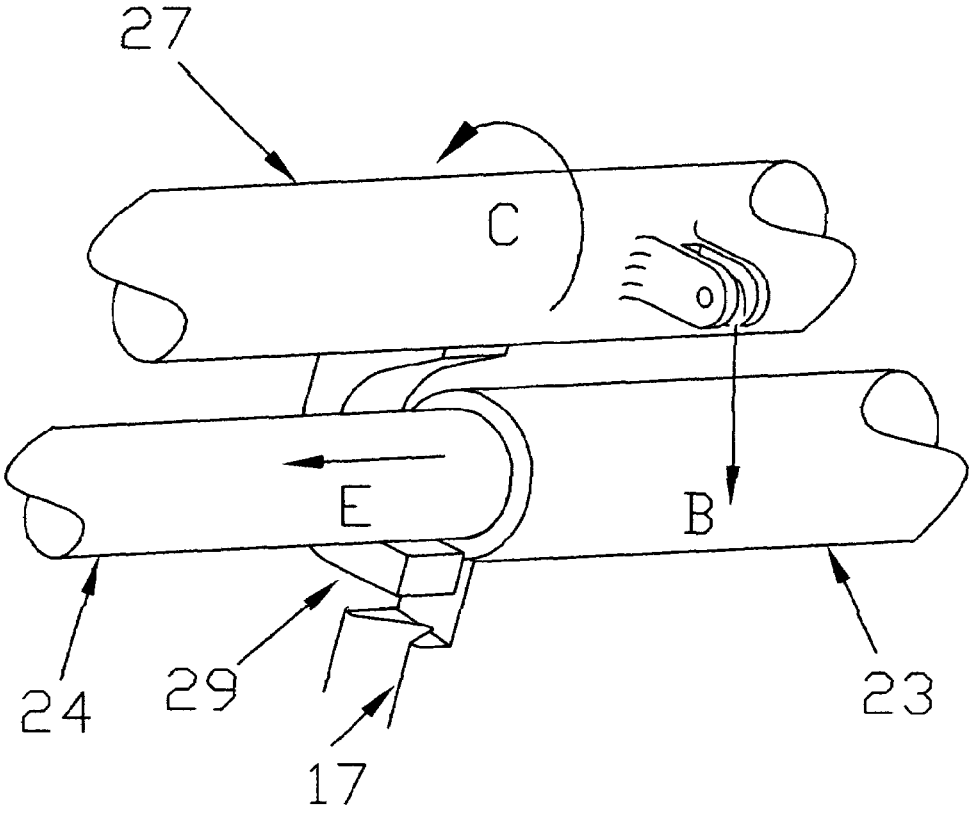
FIG. 7—Detailed view of quick close door release keeper.

Detailed operation of the preferred embodiment of the invention is shown in FIG. 6 and FIG. 7. Referring to FIG. 6, the outer casing is not shown for clarity. The door (17) is shown in the open (retracted) position. Door closure cable (34) is attached to door closure cable termination (26) mounted on door outer slide tube (23) and routed around pulleys (25). The outer end of cable (34) is attached to a bungee type material spring (15). When the door is in the closed (extended) position (not in the outer casing 33), the cable length is the length required to apply a preload to the spring (15) holding the closed door against the central mating plate (32). Retract door by applying pressure to the door (17) sliding it into the outer casing (33) (not shown) on door assembly inner slide tube (24) urging the door closure cable (34) to further stretch spring (15) until the door is fully inserted into the outer casing (33) and the door keeper (29) (FIG. 7) can be rotated in the "C" direction, by turning door keeper control tube rotation arm (28) until said keeper (29) covers the end of said door outer slide tube (23) holding said door (17) open against the spring cable tension "D".

Door (17) retraction pressure is then released and the said door (17) is held in place by said keeper (29). Door release handle (14) is in the safety lock position during said door (17) retraction and cannot be released except by removing the safety pin (36).

One of the preferred aspects of the invention is that passengers entering the cruise ship on the gangplank and through the QCDS are not aware of its existence. Operation of the QCDS is from inside the ship vestibule area by lifting either QCDS door release handle (14). Door closure would only be performed in the event of an emergency situation requiring the blocking of the entrance to the ship as in the case of a terrorist attack.

Closing of the QCDS doors is initiated by first removing the associated safety pin (36) and then lifting either release door handle (14) on the aft (9) or forward (8) QCDS. Lifting said release handle (14) applies tension to the release cable (35), which in turn places pressure to the door keeper control tube rotation arm (28) urging rotation of said arm (28). Rotation of said arm (28) allows door outer slide tube (23) (which is being pulled by spring (15)) to pass by said door keeper (29) and extend said doors (16) and (17) to fully closed position.

The QCDS is made up of mirror image forward (8) and aft (9) assemblies bolted together at the central mating plate (32). Aft/forward rotation keying tube (30) is slid into place after installation of the said forward (8) and aft (9) assemblies using keying tube insertion button (31) keying said forward (8) and aft (9) control tube rotation arms (28) together.

Activation of either forward of aft QCDS release door handle (14) will release both forward (8) and aft (9) QCDS doors. Said doors (8) and (9) meet in the middle when released with a tongue on the aft door leading edge mating with a groove in the forward door leading edge making manual door separation difficult. Door closure pressure is insured by the preload applied to both forward door (8) and aft door (9) springs (15).

Figure 8:
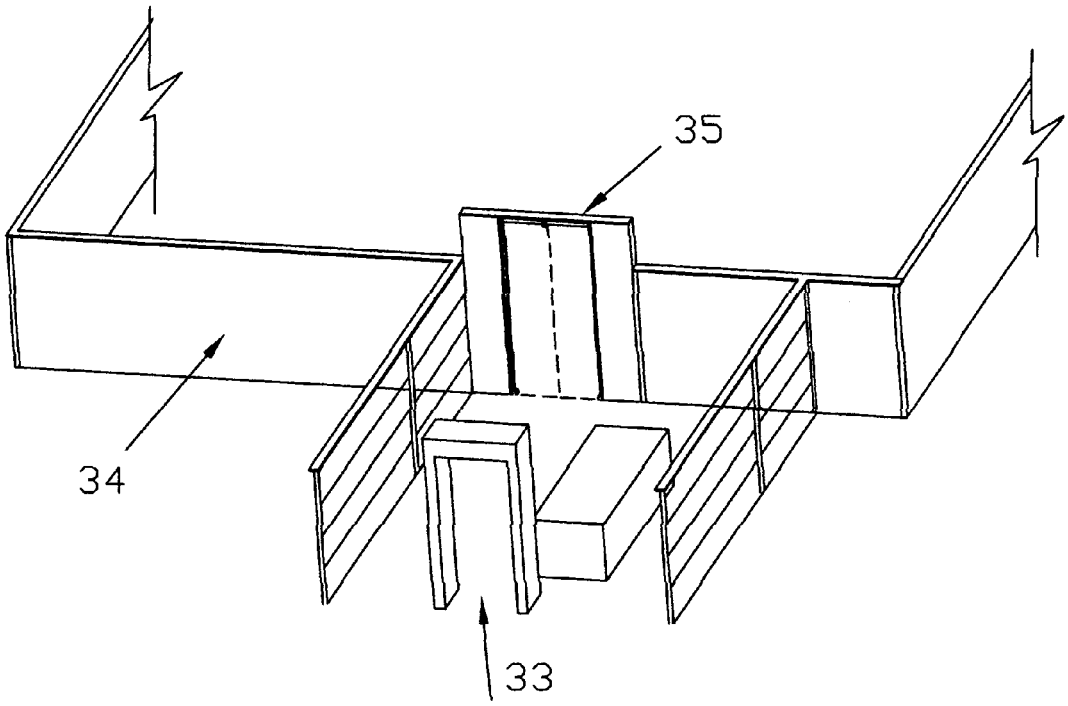
FIG. 8—Long view of public event area with quick close door system installation.
Figure 9:
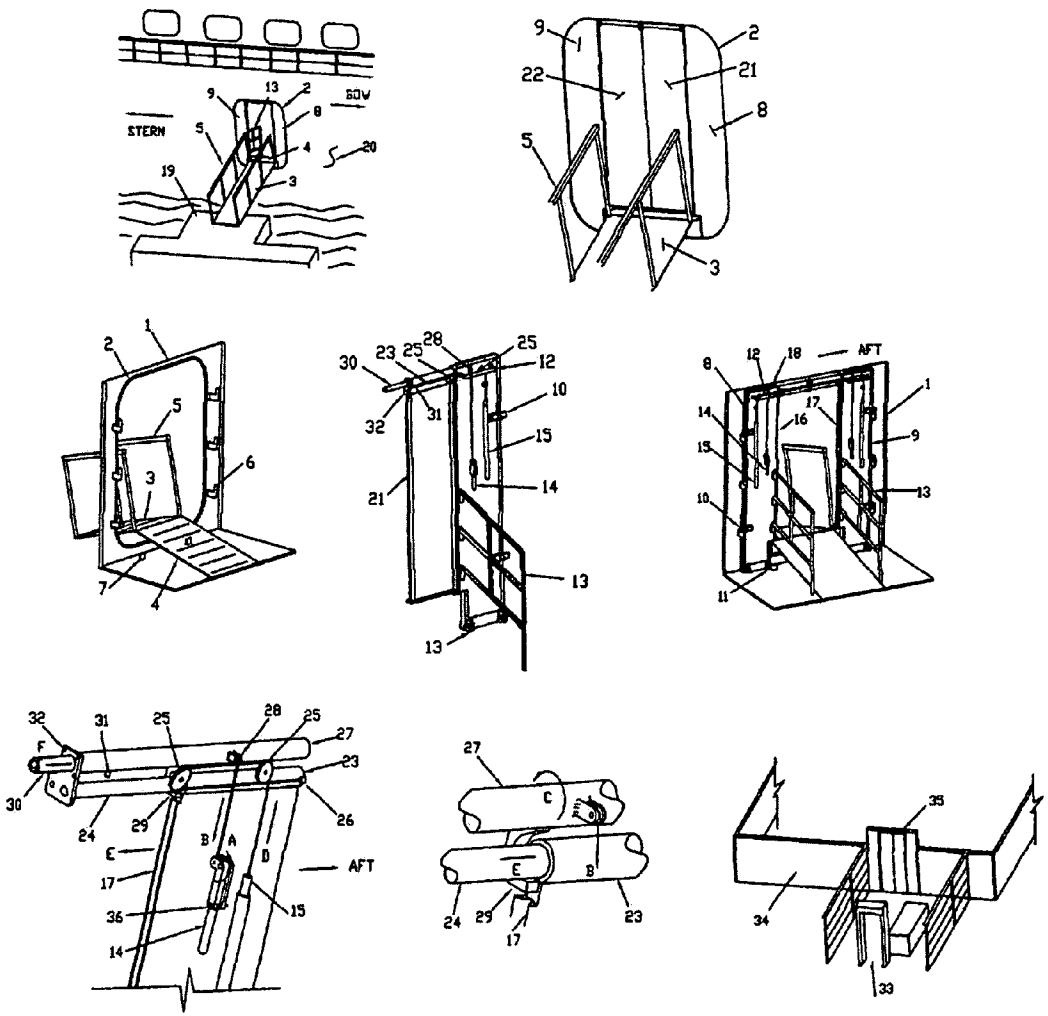
FIG. 9—Composite of FIGS. 1-8.

Another preferred aspect is the application of the invention. The embodying principles of the invention are applicable to situations other than cruise ship loading and embarkation. FIG. 8 shows a general application, which could apply to various situations as sporting events, concerts, public gatherings, public transportation gating and entrance applications. Entrance area or pre-security screening area (37) is followed by the installation of either a fixed or mobile (QCDS) (38) as defined in the preferred embodiment of this invention. The quick close door system provides a way to stop a last minute terrorist attack to a public gathering area defined by (39).

Various changes may be made to the structure and methodology embodying the principles of the invention. The foregoing embodiments are set forth within are illustrative and not in a limiting sense. Remote operation of the quick close door systems and cameras for visibility of associated areas although not shown are considered to be a part of the invention. The scope of the invention is defined by the claims appended hereto.

We claim:

1. A security apparatus comprising:

at least one door of a ship or of a water vessel and at least one outer casing;

the at least one door having a first retracted position, where said at least one door is located within the at least one outer casing, and a second extended position, where said at least one door is located outside the at least one outer casing;

a closing mechanism comprising:

a door outer slide tube, which is connected to the at least one door, a door inner slide tube, the door outer slide tube slides along the door inner slide tube, the at least one door being stationary relative to the door outer slide tube, a door closure cable, at least one pulley, and an elasticized rope, which is able to store a potential energy, the door closure cable is connected to the door outer slide tube and runs through the at least one pulley and is further connected to the elasticized rope;

a release apparatus comprising:

a release lever, a release cable, and a door keeper, the release lever is connected to a first end of the release cable;

the door keeper is connected to a second end of the release cable;

the release lever having a first position and a second position;

in the first position, the release lever, which is connected by the release cable to the door keeper, positions the door keeper to block the door outer slide tube from moving along the door inner slide tube, in the second position, the release lever is moved such that the door keeper no longer blocks the door outer slide tube from moving along the door inner slide tube and allows the release of the potential energy of the elasticized rope to push the at least one door out of the at least one outer casing.

2. The security apparatus of claim 1 further comprising bullet resistant material for the at least one door.

3. The security apparatus of claim 1 further comprising a plurality of locking bar attachments, wherein said apparatus can be easily secured to an entrance.

4. The security apparatus of claim 1 further comprising a handle and a plurality of wheels wherein said apparatus can be easily positioned to an entrance.

5. The security apparatus of claim 1 further comprising a removable handrail.

6. The security apparatus of claim 1 further comprising a safety pin, which engages the release lever in the first position and is removed in the second position.

7. A security apparatus comprising:

at least one door, door of a ship or of a water vessel, the at least one door having a first retracted position and a second extended position;

a closing mechanism comprising:

a door outer slide tube, which is connected to the at least one door, a door inner slide tube, the door outer slide tube slides along the door inner slide tube, the at least one door being stationary relative to the door outer slide tube, a door closure cable, at least one pulley, and an elasticized cord, which is able to store a potential energy;

the door closure cable is connected to the door outer slide tube and runs through the at least one pulley and is further connected to the elasticized cord;

a release apparatus comprising:

a release lever, a release cable, and a door keeper, the release lever is connected to a first end of the release cable;

the door keeper is connected to a second end of the release cable;

the release lever having a first position and a second position;

in the first position, the release lever, which is connected by the release cable to the door keeper, positions the door keeper to block the door outer slide tube from moving along the inner slide tube, in the second position, the release lever is moved such that the door keeper no longer blocks the door outer slide tube from moving along the door inner slide tube and allows the release of the potential energy of the elasticized cord to move the at least one door to the second extended position.

8. The security apparatus of claim 7 further comprising bullet resistant material for the at least one door.

9. The security apparatus of claim 7 further comprising a plurality of locking bar attachments, wherein said apparatus can be easily secured to an entrance.

10. The security apparatus of claim 7 further comprising a handle and a plurality of wheels wherein said apparatus can be easily positioned to an entrance.

11. The security apparatus of claim 7 further comprising a removable handrail.

12. The security apparatus of claim 7 further comprising a safety pin, which engages the release lever in the first position and is removed in the second position.

13. A security apparatus comprising:

at least one door of a ship or of a water vessel and at least one outer casing, the at least one door having a first retracted position, where said at least one door is located within the at least one outer casing, and a second extended position, where said at least one door is located outside the at least one outer casing;

a closing mechanism comprising:

a door outer slide tube, which is connected to the at least one door, a door inner slide tube, the door outer slide tube engages and slides along the inner slide tube, the at least one door being stationary relative to the door outer slide tube, a door closure cable, at least one pulley, and an elasticized rope, which is capable of storing a potential energy;

the door closure cable is connected to the door outer slide tube and runs through the at least one pulley and is further connected to the elasticized rope;

a release mechanism comprising:

a release lever, a release cable, a door keeper control tube, and a door keeper, which is located on the door keeper control tube, the release lever is connected to a first end of the release cable;

the door keeper control tube is connected to a second end of the release cable;

the release lever having a first position and a second position;

in the first position of the release lever, the release lever, which is connected to the door keeper control tube by the release cable, maintains the door keeper in a first door keeper position, and the door keeper blocks the door outer slide tube from moving along the door inner slide tube;

in the second position of the release lever, the release lever is moved such that the door keeper assumes a second door keeper position and no longer blocks the door outer slide tube from moving along the door inner slide tube and allows the release of the stored potential energy of the elasticized rope to push the at least one door out of the at least one outer casing.

14. A security apparatus comprising:

A first door side and a second door side, each first and second door sides comprising:

a door of a ship or of a water vessel and an outer casing;

each door having a first retracted position, where each door is located within the corresponding outer casing, and a second extended position, where each door is located outside the corresponding outer casing;

a door keeper control tube, a door rotation keying tube, which lies within the door keeper control tube;

the first door side having a first keying tube engaging end;

the second door side having a second keying tube engaging end;

where the first and the second keying tube engaging ends interact to allow said keying tubes to act simultaneously;

a keying tube insertion button to engage the keying tube to the door keeper control tube;

a central mating plate, where the first door and second door sides are fixedly engaged;

a closing mechanism comprising:

a door outer slide tube, a door inner slide tube, the door outer slide tube engages and slides along the inner slide tube, the at least one door being stationary relative to the door outer slide tube, a door closure cable, at least one pulley, and a bungee cord, which is capable of storing potential energy, the door closure cable is connected to the door outer slide tube and runs through the at least one pulley and is further connected to the bungee cord;

a release apparatus comprising:

a release lever, a locking pin, which removably engages the release lever from unintended movement, a release cable, a door keeper, the release lever is connected to a first end of the release cable;

the door keeper is connected to a second end of the release cable;

the release lever having a first closed position and a second open position;

in the first closed position, the release lever is connected by the release cable to the door keeper such that the door keeper blocks the door outer slide tube from moving along the inner slide tube, in the second open position and after the release pin is disengaged, the release lever is moved such that the door keeper no longer blocks the door outer slide tube from moving along the door inner slide tube and the stored potential energy of the bungee cord drives each door to the second extended position and outside the at least one outer casing.

15. A method of using a security apparatus having at least one door of a ship or of a water vessel and at least one outer casing;

the at least one door having a first retracted position, where said at least one door is located within the at least one outer casing, and a second extended position, where said at least one door is located outside the at least one outer casing;

a closing mechanism comprising:

a door outer slide tube, which is connected to the at least one door, a door inner slide tube, the door outer slide tube slides along the inner slide tube, the at least one door being stationary relative to the door outer slide tube, a door closure cable, at least one pulley, and a bungee rope, which is able to store a potential energy, the door closure cable is connected to the door outer slide tube and runs through the at least one pulley and is further connected to the bungee rope;

a release apparatus comprising:

a release lever, a locking pin, which removably engages the release lever from unintended movement, a release cable, and a door keeper, the release lever is connected to a first end of the release cable;

the door keeper is connected to a second end of the release cable;

the release lever having a first position and a second position;

in the first position, the release lever, which is connected by the release cable to the door keeper, positions the door keeper to block the door outer slide tube from moving along the door inner slide tube, Comprising the following steps:

(a) Disengaging the locking pin from the release lever;

(b) Moving the release lever from the first position to the second position, whereby as the release lever is moved, the door keeper assumes a second door keeper position and no longer blocks the door outer slide tube from moving along the door inner slide tube and allows the release of the stored potential energy of the bungee rope to push the at least one door out of the at least one outer casing and to assume the second extended position;

(c) Applying an opposing force to the at least one door, which causes the door to retract into at least one outer casing and to assume the first retracted position and to load the bungee rope with said potential energy;

(d) Moving the release lever to the first position, which moves said door keeper and blocks the door outer slide tube; and (e) Re-engaging the locking pin to the release lever.

16. A method of using a security apparatus having at least one door of a ship or of a water vessel and at least one outer casing, the at least one door having a first retracted position, where said at least one door is located within the at least one outer casing, and a second extended position, where said at least one door is located outside the at least one outer casing;

a closing mechanism comprising:

a door outer slide tube, which is connected to the at least one door, a door inner slide tube, the door outer slide tube engages and slides along the inner slide tube, the at least one door being stationary relative to the door outer slide tube, a door closure cable, at least one pulley, and an elasticized cord, the door closure cable is connected to the door outer slide tube and runs through the at least one pulley and is further connected to the elasticized cord, the elasticized cord being capable of storing a potential energy;

a release mechanism comprising:

a release lever, a locking pin, which removably engages the release lever from unintended movement, a release cable, a door keeper control tube, and a door keeper, which is located on the door keeper control tube, the release lever is connected to a first end of the release cable;

the door keeper control tube is connected to a second end of the release cable;

the release lever having a first position and a second position;

in the first position of the release lever, the release lever, which is connected to the door keeper control tube by the release cable, maintains the door keeper in a first door keeper position, and the door keeper blocks the outer slide tube from moving along the inner slide tube, Comprising the following steps:

(a) Disengaging the locking pin from the release lever;

(b) Moving the release lever from the first position to the second position, whereby as the release lever is moved, the door keeper assumes a second door keeper position and no longer blocks the door outer slide tube from moving along the door inner slide tube and allows the release of the stored potential energy of the elasticized cord to push the at least one door out of the at least one outer casing and to assume the second extended position;

(c) Applying an opposing force to the at least one door, which causes the door to retract into the at least one outer casing and to assume the first retracted position and to load the elasticized cord with said potential energy;

(d) Moving the release lever to the first position, which moves said door keeper and blocks the door outer slide tube; and (e) Re-engaging the locking pin to the release lever.

17. A security apparatus comprising:

at least one door of a ship or of a water vessel and at least one outer casing;

the at least one door having a first retracted position, where said at least one door is located within the at least one outer casing, and a second extended position, where said at least one door is located outside the at least one outer casing;

a closing mechanism comprising:

a door outer slide tube, which is connected to the at least one door, a door inner slide tube, the door outer slide tube slides along the door inner slide tube, the at least one door being stationary relative to the door outer slide tube, a door closure cable, at least one pulley, and a bungee cord, which is able to store a potential energy, the door closure cable is connected to the door outer slide tube and runs through the at least one pulley and is further connected to the bungee cord;

a release apparatus comprising:

a release lever, a release cable, and a door keeper, the release lever is connected to a first end of the release cable;

the door keeper is connected to a second end of the release cable;

the release lever having a first position and a second position;

in the first position, the release lever, which is connected by the release cable to the door keeper, positions the door keeper to block the door outer slide tube from moving along the door inner slide tube, in the second position, the release lever is moved such that the door keeper no longer blocks the door outer slide tube from moving along the door inner slide tube and allows the release of the potential energy of the bungee cord to push the at least one door out of the at least one outer casing.

18. A security apparatus comprising:

at least one door of a ship or of a water vessel, the at least one door having a first retracted position and a second extended position;

a closing mechanism comprising:

a door outer slide tube, which is connected to the at least one door, a door inner slide tube, the door outer slide tube slides along the door inner slide tube, the at least one door being stationary relative to the door outer slide tube, a door closure cable, at least one pulley, and an elasticized rope, which is able to store a potential energy;

the door closure cable is connected to the door outer slide tube and runs through the at least one pulley and is further connected to the elasticized rope;

a release apparatus comprising:

a release lever, a release cable, and a door keeper, the release lever is connected to a first end of the release cable;

the door keeper is connected to a second end of the release cable;

the release lever having a first position and a second position;

in the first position, the release lever, which is connected by the release cable to the door keeper, positions the door keeper to block the door outer slide tube from moving along the inner slide tube, in the second position, the release lever is moved such that the door keeper no longer blocks the door outer slide tube from moving along the door inner slide tube and allows the release of the potential energy of the elasticized rope to move the at least one door to the second extended position.

* * * * *